US006796072B2

(12) United States Patent
Barber et al.

(10) Patent No.: US 6,796,072 B2
(45) Date of Patent: Sep. 28, 2004

(54) FIREARM SAFETY DEVICE

(75) Inventors: Robert R. Barber, Cranston, RI (US); William F. Loux, Cranston, RI (US); Michael A. D'Agostino, Swansea, MA (US)

(73) Assignee: Ammo-Safe, Inc., Cranston, RI (US)

( * ) Notice: Subject to any disclaimer, the term of this patent is extended or adjusted under 35 U.S.C. 154(b) by 0 days.

(21) Appl. No.: 10/248,533

(22) Filed: Jan. 27, 2003

(65) Prior Publication Data

US 2003/0221351 A1 Dec. 4, 2003

Related U.S. Application Data

(60) Provisional application No. 60/354,067, filed on Jan. 31, 2002, and provisional application No. 60/380,342, filed on May 13, 2002.

(51) Int. Cl.[7] ..... F41A 17/44
(52) U.S. Cl. ..... 42/70.11
(58) Field of Search ..... 42/70.01, 70.08, 42/70.11

(56) References Cited

U.S. PATENT DOCUMENTS

| | | | | | |
|---|---|---|---|---|---|
| 2,327,334 | A | * | 8/1943 | Parker | 42/70.11 |
| 2,479,107 | A | * | 8/1949 | Garretson | 42/76.01 |
| 2,763,081 | A | | 9/1956 | Huckabee | 42/1 |
| 2,887,807 | A | | 5/1959 | Santangelo | 42/1 |
| 3,022,598 | A | | 2/1962 | Wikstrom | 42/66 |
| 3,027,674 | A | | 4/1962 | Mahan | 42/66 |
| 3,208,176 | A | | 9/1965 | Giles | 42/66 |
| 3,360,880 | A | | 1/1968 | Finnegan | 42/66 |
| 4,136,476 | A | | 1/1979 | Hetrick | 42/1 |
| 4,224,753 | A | | 9/1980 | Bielman | 42/1 |
| 4,398,366 | A | | 8/1983 | Wernicki | 42/1 |
| 4,908,971 | A | | 3/1990 | Chaney | 42/70.11 |
| 5,038,508 | A | | 8/1991 | Brown | 42/70.11 |
| 5,357,704 | A | | 10/1994 | Benkovic | 42/70.11 |
| 5,475,994 | A | * | 12/1995 | Briley et al. | 70/34 |
| 5,488,794 | A | * | 2/1996 | Arrequin | 42/70.11 |
| 5,918,403 | A | | 7/1999 | Lurz, Jr. et al. | 42/70.11 |
| 6,393,750 | B1 | * | 5/2002 | Rossini et al. | 42/70.11 |
| 6,526,684 | B1 | * | 3/2003 | Hickerson | 42/70.11 |
| 6,604,313 | B1 | * | 8/2003 | Kress | 42/70.11 |
| 2002/0092223 | A1 | * | 7/2002 | Blomquist et al. | 42/70.11 |
| 2002/0112389 | A1 | * | 8/2002 | Kellerman | 42/70.11 |
| 2002/0189148 | A1 | * | 12/2002 | Hanson | 42/70.11 |

FOREIGN PATENT DOCUMENTS

| | | | | |
|---|---|---|---|---|
| GB | 22202553 A | * | 1/1990 | F41A/17/44 |
| WO | WO 92/06345 | * | 4/1992 | 42/70.11 |

* cited by examiner

*Primary Examiner*—Michael J. Carone
*Assistant Examiner*—Gabriel S. Sukman
(74) *Attorney, Agent, or Firm*—Barlow, Josephs & Holmes, Ltd.

(57) ABSTRACT

The firearm safety device includes a cylindrical cartridge plug which is insertable into a firing chamber of the barrel of a firearm. One end of the cartridge plug is positioned proximal to the opening of the bore through the barrel and the other end is positioned proximal to a firing pin of the firearm. The cartridge plug has a smooth outer surface which is in communication with an extraction finger of the firearm. A number of protrusions emanate outwardly from the outer surface of the cartridge plug. The protrusions are frictionally engageable with the inner wall of the firing chamber to maintain the plug within the firing chamber. An elongated indicator member is connected to the end of the cartridge plug which is proximal to the bore. The other end of the elongated indicator member extends completely through the bore of the barrel so that it is visible outside the barrel of the firearm to indicate to the user that the firearm is in a safe condition and cannot be fired.

13 Claims, 8 Drawing Sheets

FIREARM SAFETY DEVICE

CROSS REFERENCE TO RELATED APPLICATIONS

This application claims the benefit of U.S. provisional application 60/354,067 having a filing date of Jan. 31, 2002 and U.S. provisional application 60/380,342 having a filing date of May 13, 2002.

BACKGROUND OF THE INVENTION

The present invention relates to firearms, namely, the safe operation, training, storage, display and transportation thereof. In particular, the present invention relates to making a firearm safer by clearly indicating to the user that the chamber of a firearm is devoid of a round and cannot be fired.

In the prior art, firearms include a firing chamber for receiving a live round. Additional rounds are commonly provided in a magazine, for example, for later introduction into the firing chamber for subsequent firing. When the firing pin is engaged with the live round that is in the firing chamber, the ammunition is driven through the chamber and the remaining cartridge casing is left remaining. An extractor rod with a finger connected thereto, for example, is then employed to remove the casing through the breach. Depending on the mechanics of the firearm, the next live round is loaded into the firing chamber either manually or automatically.

Most notably, however, it is possible for a live round to remain in the chamber even when the supply of live rounds, such as a clip or magazine, is removed from the firearm. This raises a significant safety issue in that a firearm may appear to be safe because the clip or magazine has been removed but is actually not safe because a live round independently remains in the chamber ready for firing. Thus, a firearm can fire a round even when there is no clip or magazine loaded into the firearm.

There have been many attempts in the prior art to solve the aforementioned problems associated with a round left remaining within the firing chamber of a firearm. These prior art safety devices are typically designed to effectively render the firearm completely unusable by locking it in some fashion. These devices are well-suited for preventing unwanted use of the firearm, such as by children.

For example, various safety devices have been provided in the prior art that provide an assembly that locks onto the barrel of the firearm to render the entire firearm unusable. These devices typically include a rod that is routed through the barrel from the firing chamber and is clipped or secured to the open end of the barrel to prevent removal of the safety device. Either or both the firing chamber and the bore of the barrel are blocked to prevent operation of the firearm.

These devices suffer from the inherent problems associated with employing any type of locking structure, namely, the requirement of use of a key to unlock the firearm to use it and inconvenience if the key is lost. These types of safety devices are particularly ill-suited for individuals who frequently use firearms, such as law enforcement officers, or individuals who need to quickly use a firearm in an emergency situation, such as a homeowner in self-defense during a burglary.

Other prior art safety devices are employed for indicating to the user that the firing chamber is devoid of a live round. In these situations, a user does not want the firearm to be completely disabled by a locking mechanism but merely to indicate that the firearm is safe to handle and cannot be accidentally fired. These types of safety devices are particularly useful for experienced firearm users, such as law enforcement officers and hunters.

The prior devices that provide some type of safe condition indication without the unwanted complete locking also typically employ an indication member that extends from a plug that is positioned with the firing chamber of the firearm. However, these prior art safety devices require awkward clips, springs or fasteners for securing the safety device to the barrel or the body of the firearm. As a result, these safety devices are cumbersome to install and use. Also, they are difficult to secure in place on or in the firearm to maintain the safety protection of the device.

While these type safety devices have the primary goal of indicating to the user that the firing chamber is devoid of a live round, they also have the effect of rendering the firearm unusable as well because the firing chamber is completely blocked. While this may be desirable in certain situations and for certain users to render the firearm completely unusable, there are other situations where it is desirable for the firearm to continue to operation, i.e. dry fire. The ability to dry fire a firearm while simultaneously knowing, with certainty, that the firearm will not fire an actual round, is critical for use in training exercises, such as for law enforcement officers, and the like.

Therefore, there is a need for a safety device that clearly indicates to the user with certainty that the chamber of the firearm is free and clear of a live round so that the user can be confident that the firearm cannot be fired even when the clip or magazine is removed. There is also a demand for a firearm safety device that can also permit the firearm to be dry fired, holstered and the weapon system thereof cycled in a normal fashion to closely simulate actual firearm use for employment in training exercises and the like.

SUMMARY OF THE INVENTION

The present invention preserves the advantages of prior art firearm safety devices. In addition, this firearm safety device provides new advantages not found in prior art firearm safety devices, and overcomes many of the disadvantages of such devices.

The invention is generally directed to a new, novel and unique firearm safety device for use to clearly indicate that the firearm is in a safe condition. As a result, the firearm safety device of the present invention is well-suited to secure a firearm used during training without fear that the firearm may fire a live round.

The firearm safety device of the present invention includes a cylindrical cartridge plug which is insertable into a firing chamber of the barrel of a firearm. One end of the cartridge plug is positioned proximal to the opening of the bore through the barrel and the other end is positioned proximal to a firing pin of the firearm. The cartridge plug has a smooth outer surface which is in communication with an extraction finger of the firearm. A number of protrusions emanate outwardly from the outer surface of the cartridge plug. The protrusions are frictionally engageable with the inner wall of the firing chamber to maintain the plug within the firing chamber. An elongated indicator member is connected to the end of the cartridge plug which is proximal to the bore. The other end of the elongated indicator member extends completely through the bore of the barrel so that it is visible outside the barrel of the firearm to indicate to the user that the firearm is in a safe condition and cannot be fired.

For installation of the firearm safety device of the present invention, the free end of the elongated indication member is routed through the bore of the barrel via the breach. The cartridge plug is then seated within the firing chamber and frictionally secured in place by the engagement of the protrusions into the inner wall of the firing chamber. This frictional engagement prevents the safety device from being easily extracted due to the frictional engagement of the cartridge plug from the firing chamber.

With the cartridge plug securely in place, the elongated indication member is dimensioned to extend beyond the open end of the bore of the barrel to be plainly visible to the eye. The length of the indication member may be trimmed to size as desired by the user leaving at least 3.5 inches exposed.

It is therefore an object of the present invention to provide a firearm safety device that effectively and accurately indicates the safe condition of a firearm where a live round cannot be fired or loaded and where live ammunition cannot be introduced once the safety device is in place.

An additional object of the present invention is to provide a firearm safety device that does not render the firearm completely unusable but unable to fire or introduce a live round.

Another object of the present invention is to provide a firearm safety device that can be dry fired.

It is another object of the present invention to provide a firearm safety device that can be easily installed and removed.

It is a further object of the present invention to provide a firearm safety device that is easy and cost effective to manufacture.

It is yet a further object of the present invention that allows for holstering of a firearm that has the firearm safety device of the present invention installed therein.

It is another object of the present invention to provide a firearm safety device that can be easily customized by the user.

Yet another object of the invention is to provide a safety device that permits the weapons system of the firearm to be cycled without extracting the safety device.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION

Figure 1:
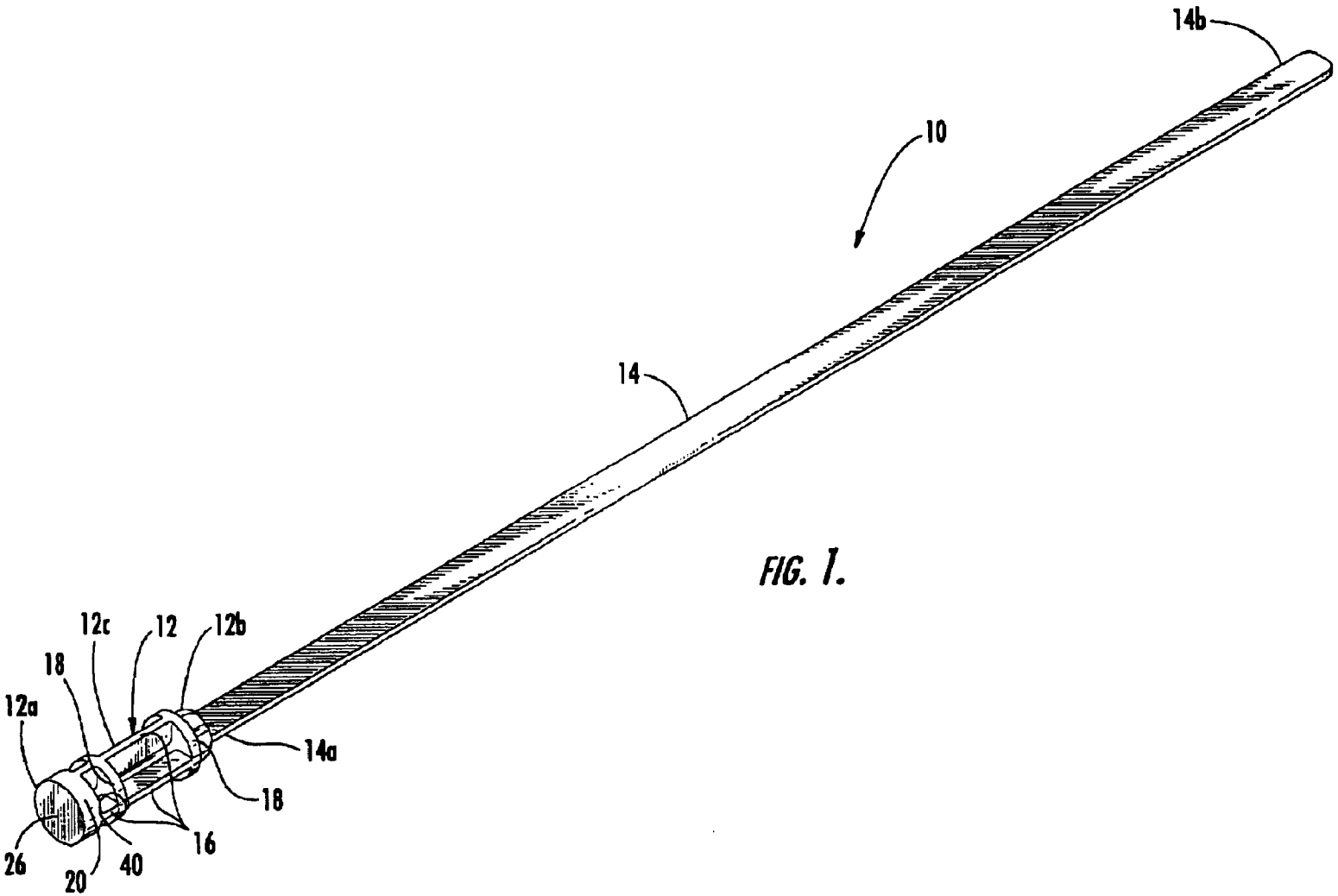
FIG. 1 is a perspective view of the firearm safety device of the present invention.
Figure 2:
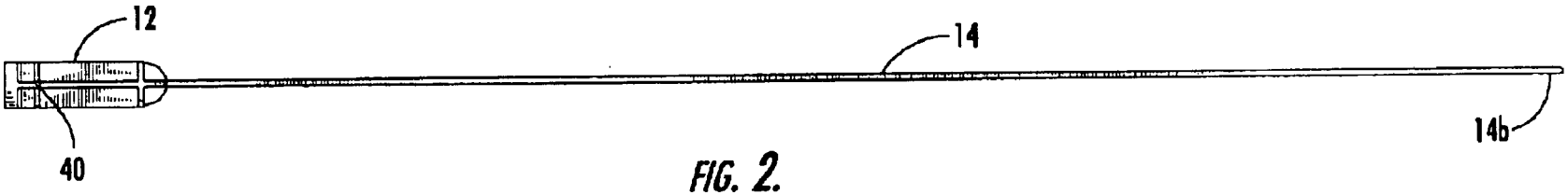
FIG. 2 is a side elevational view of the firearm safety device of FIG. 1.
Figure 3:
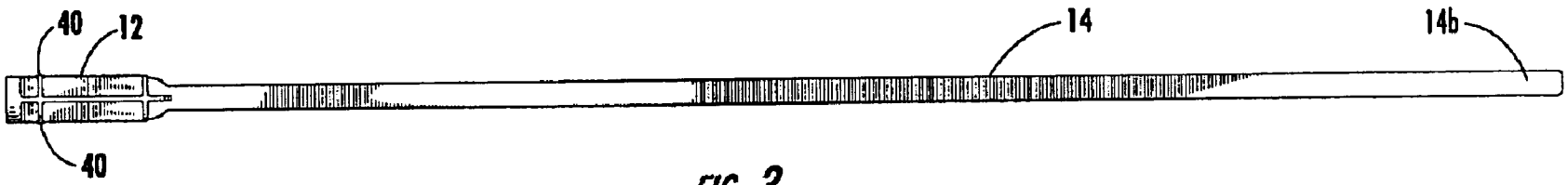
FIG. 3 is a top view of the firearm safety device of FIG. 1.

Referring first to FIG. 1, a perspective view of the firearm safety device 10 is shown. The firearm safety device 10 generally includes a cartridge plug 12 and an indicator member 14 which, preferably, has an elongated configuration. One end 12*b* of the cartridge plug 12 is connected to an end 14 a of the indicator member 14 to form the safety device 10 of the present invention.

The cartridge plug 12 is formed of a configuration that closely simulates the shape and configuration of an actual ammunition round. More specifically, the cartridge plug 12 includes a body portion 12*c* that simulates an actual cartridge and a head portion 12*b* that simulates an actual slug of the round. As can be seen in FIGS. 1–3 and 5, the indicator member 14 is attached to the head portion 12*b* of the cartridge plug 12.

Figure 4:
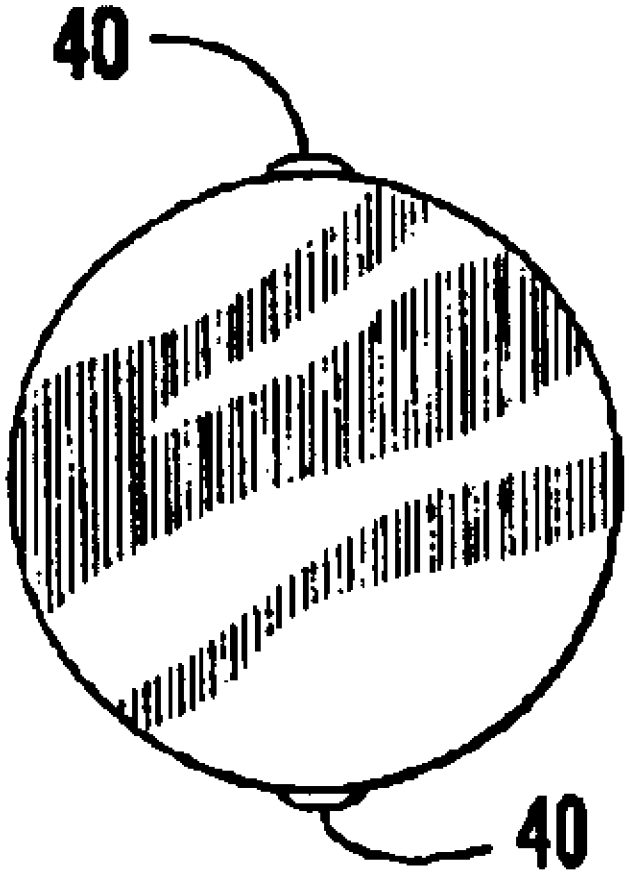
FIG. 4 is a left elevational view of the firearm safety device of FIG. 1.

The body portion 12*c* preferably includes a number of longitudinal ribs 16 and horizontal ribs 18. These ribs 16, 18 not only structurally reinforce the body portion 12*c* of the cartridge plug 12 but also aid in the manufacture of the device 10. The use of ribs 16, 18 reduces the amount of material used to form the safety device 10 of the present invention. More specifically, the entire firearm safety device 10 of the present invention is preferably formed by molding, such as an injection molding process. Both the cartridge plug 12 and the indicator member 14 are preferably unitarily and integrally molding at the same time using the same mold to form the firearm safety device 10 of the present invention. As will be described in detail below in connection with FIGS. 7 and 8, the body portion 12*c* of the cartridge plug 12 also includes a base 12*a* with a smooth outer surface 20 to communicate with the extraction finger 22 of a firearm 24. Also, the bottom 26 of the base portion 12*a*, as shown in FIG. 4, communicates with the firing pin 28 of a firearm 24.

It should be understood that the shape, configuration and length of the cartridge plug 12 and indicator member 14 may be easily modified to suit the firearm 24 at hand. The firearm safety device 10 of the present invention is shown in FIGS. 1–5 by way of example. In this example, the firearm safety device 10 of the present invention is configured for installation into and use with a 9 mm pistol 24. It is possible to configure the firearm safety device 10 to accommodate pistols of different sizes and even rifles. In these firearms, the size, configuration and length of the cartridge plug 12 and indicator member 14 are modified accordingly.

Figure 5:
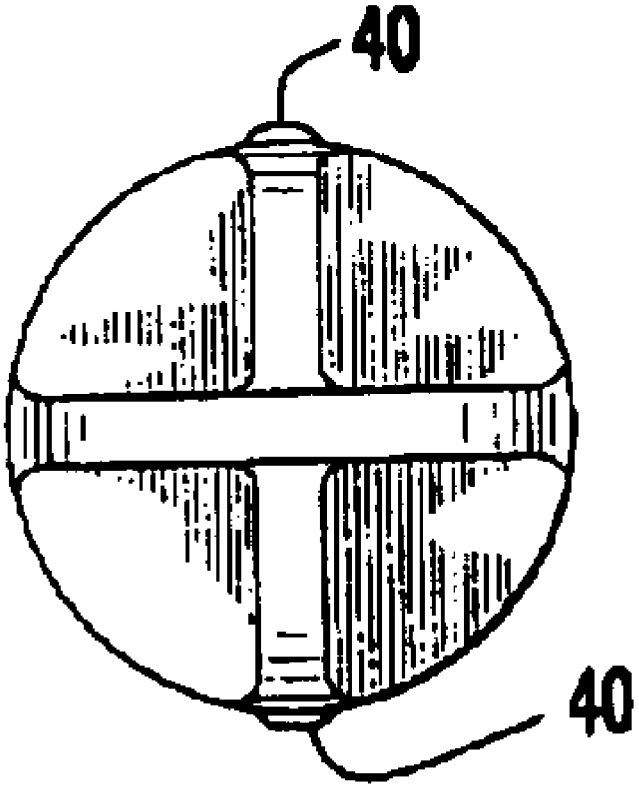
FIG. 5 is a right elevational view of the firearm safety device of FIG. 1.
Figure 6:
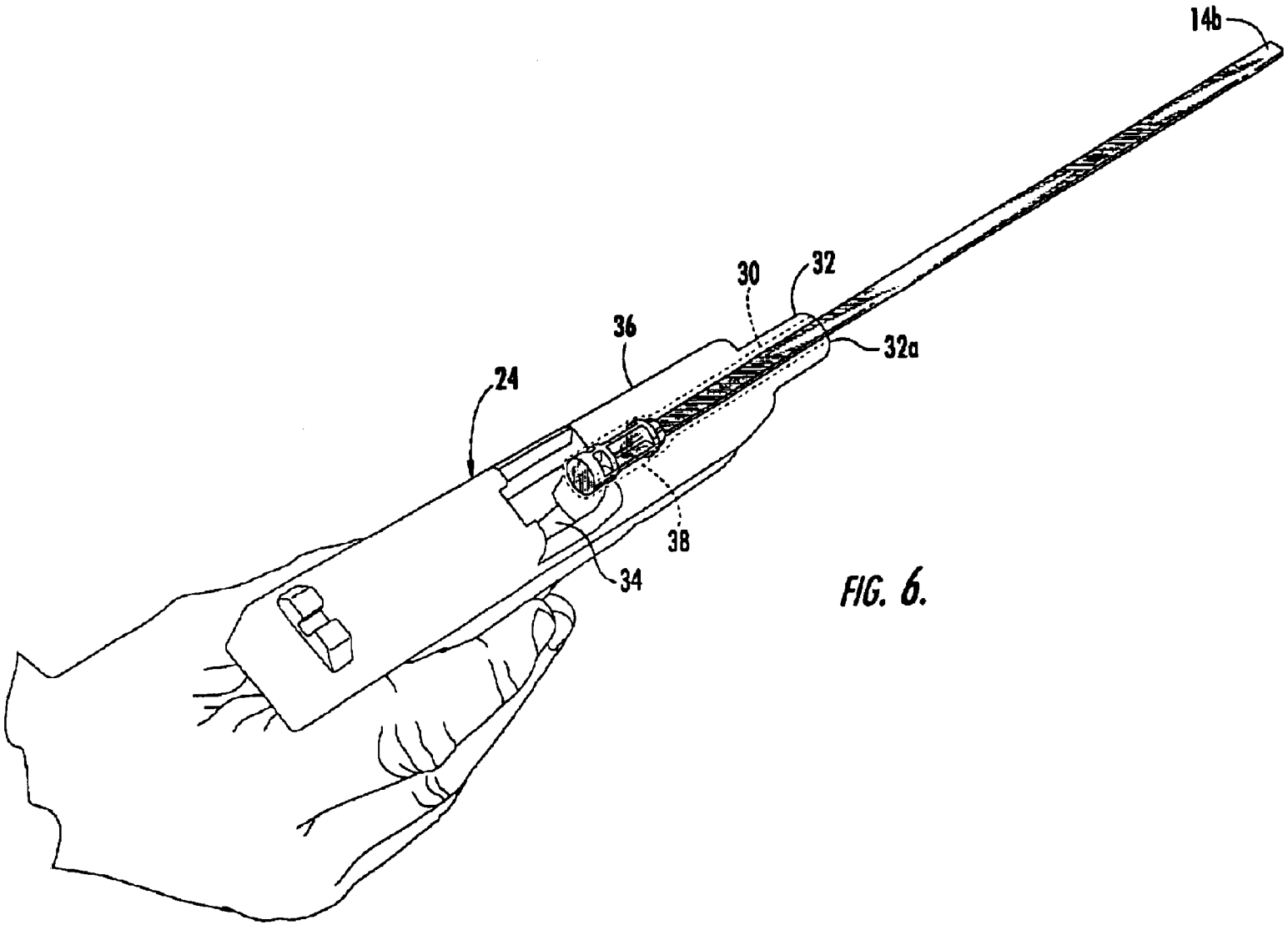
FIG. 6 is a perspective view of the firearm safety device installed in a firearm.
Figure 8:
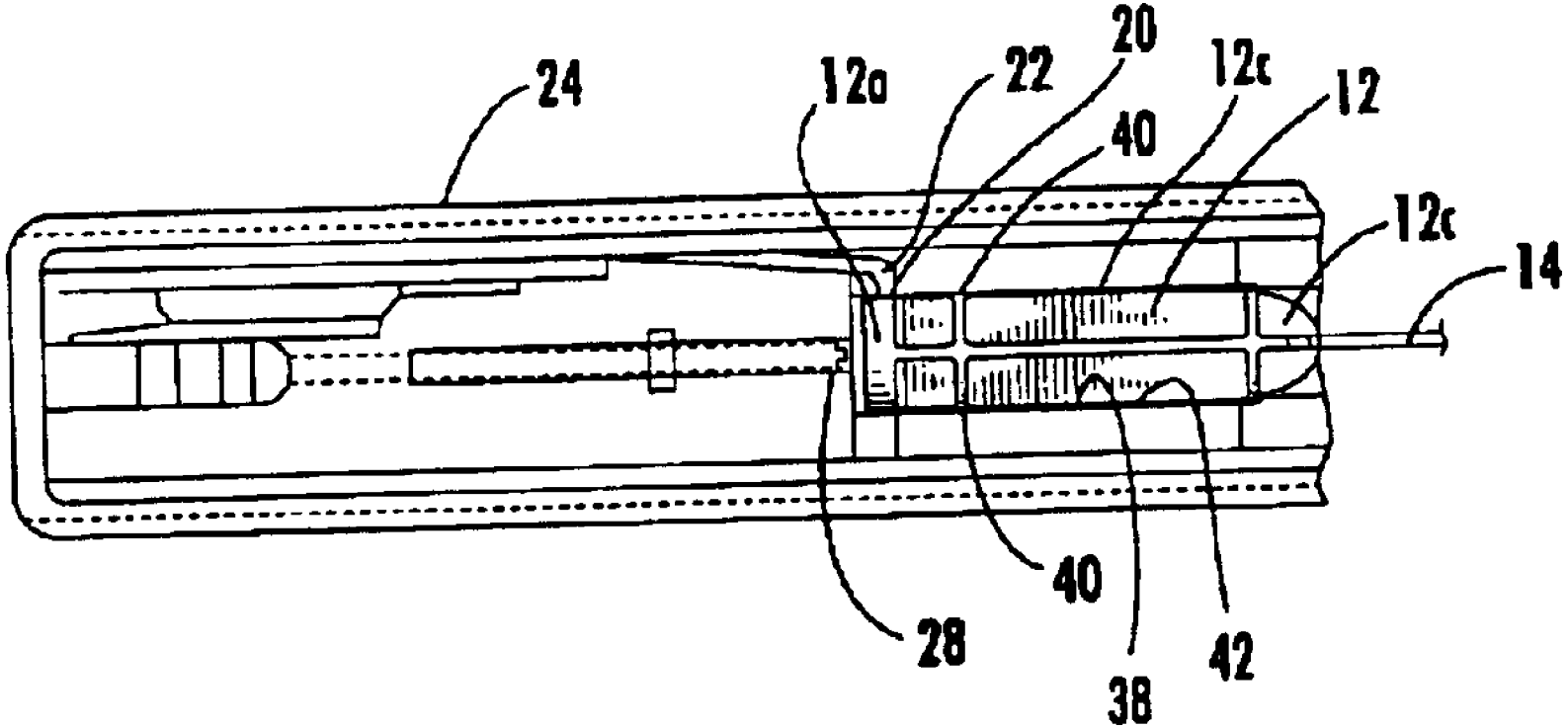
FIG. 8 is a top partial cross-sectional view of a firearm with an extraction finger engaging the cartridge plug of the firearm safety device of the present invention.

Turning now to FIG. 6, use an operation of the firearm safety device 10 of the present invention is shown. The free end 14*b* of the indicator member 14 is first inserted through the bore 30 of the barrel 32 via the breach 34 of the firearm 24. In the 9 mm firearm 24 example shown in FIG. 6, the slide 36 is first retracted to fully expose the breach 34 of the firearm 24. With the breach 34 kept open, the cartridge plug 12 is pushed into seating engagement with the firing chamber 38. The free end 14*b* of the indicator member 14 may be pulled to assist in seating the cartridge plug 12 in the firing chamber 38. As shown in FIGS. 4, 5 and 8, protrusions 40 emanate from the cartridge plug 12 frictionally engage with the inner wall 42 of the firing chamber 38 of the firearm 24 to further secure the cartridge plug 12 in place and thereby secure the entire firearm safety device 10.

For a round to be fired in a the firearm shown in FIG. 6, a live round must be installed into the firing chamber 38.

However, it can be readily appreciated that it is physically impossible for such a live round to reside in the firing chamber 38 because it is already occupied by the cartridge plug 12. Therefore, with the firearm safety device 10 properly installed, the firearm 24 is in a safe condition and can be handled without fear that a round will be fired or accidentally introduced. This condition is plainly identified by the indicator member 14 extending from the barrel 32 of the firearm 24. As seen in FIG. 6, the indicator member 14 extends well beyond the open end 32*a* of the barrel 32 of the firearm 24. The length of the indicator member 14 may be trimmed as desired but it is recommended that at least a 3.5 inches remain extending beyond the open end 32*a* of the barrel 32 to clearly indicate that the firearm 24 is in a safe condition due to installation of the cartridge plug 12 in the firing chamber 38.

The indicator member 14 is preferably flat in configuration with a rectangular cross-section for ease of manufacture. Further the flat configuration also permits flexing in only one direction which is along the flat side of the indicator member 14. In this flat configuration, the indicator member 14 cannot flex along the short edge. Thus, there is more control of the flexing of the indicator member 14. Also, the indicator member 14 may be oval or circular in cross-section to suit the particular firearm 24 at hand. In this case, the indicator member 14 may flex in all directions.

Also, the indicator member 14 is preferably yellow to unmistakably show that the firearm safety device 10 of the present invention is installed in the firearm 24 at hand. However, other colors may be employed and still be within the scope of the present invention. If the indicator member 14 is integrally formed with the cartridge plug 14, then the plug through fusion molding, for example, is preferably color coded as well as caliber specific. This color is preferably achieved by employing a colored plastic for use in the molding process. For example, the following color coding scheme is preferably employed but other schemes may also be used.

Caliber Color Coding Scheme

| CALIBER | COLOR |
|---|---|
| AS9 9 mm/.357 SIG handgun | Yellow #N-204555-2 |
| AS40 - .40 S&W/10 mm handgun | Misty Blue #UN55484 |
| AS45 - .45 ACP handgun | Dew Drop #UN66301 |
| AS9S 9 mm/.357 SIG Sub-machine Gun | Pineapple #UN1740HT |
| AS40S - .40 S&W/10 mm Sub-machine Gun | Value Blue #UN5972 |
| AS45S - .45 ACP Sub-machine Gun | Trans Lime #UN1833TR |
| AS223 - .223/5.56 NATO Long-Gun | White C #NY12057 |
| AS308 - .308/7.62 NATO Long-Gun | Pink C #NY12054 |
| AS12 12 gauge Shotgun | Orange Fresh #UN2264HT |

While brightly colored injection molded plastic is preferably employed for the firearm safety device 10 of the present invention, other materials, such as metal or nylon may alternatively be used. These materials may be painted or plated to achieve the desired colors.

A unique and important feature of the firearm safety device 10 of the present invention is the ability to accommodate dry firing and cycling of the firearm 24 even when the device 10 is fully installed. Dry firing is the firing of the firearm 24 with no rounds present in the firing chamber 38 or in the entire firearm 24 for that matter. Such dry firing is frequently employed during training exercises for law enforcement officers, and the like. For realistic training, it is critical that the firearm 24 function normally, that is, completely cycle with the firing pin 28 striking upon pulling of the trigger (not shown). It is also important that the user be able to holster the firearm 24 in the normal fashion. Dry firing and full holstering of a firearm 24 equipped with the firearm safety device 10 of the present invention is possible with the present invention.

Figure 7:
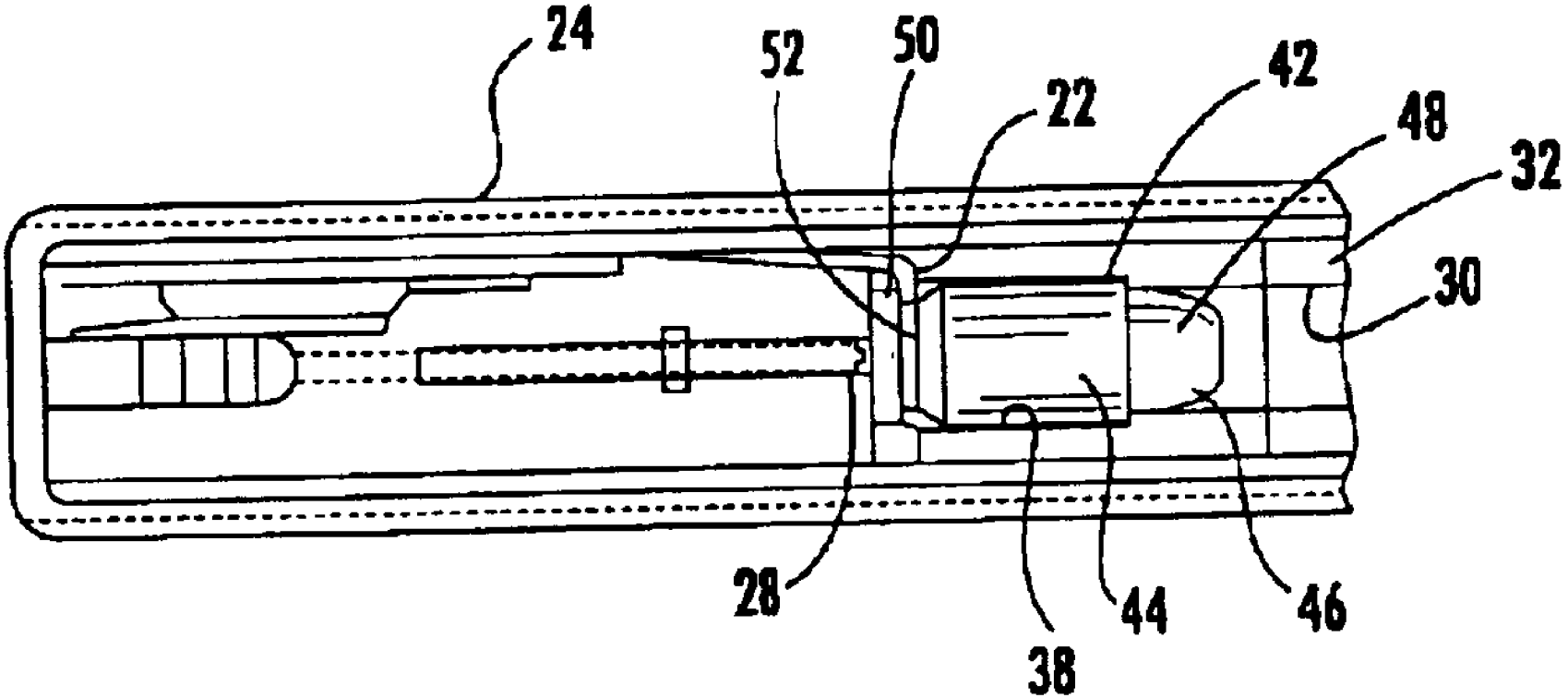
FIG. 7. (PRIOR ART)
FIG. 7 is a top partial cross-sectional view of a firearm with an extraction finger engaging a prior art cartridge round.

Referring now to FIGS. 7 and 8, the ability of the device 10 of the present invention to accommodate dry firing is shown in detail. FIG. 7 illustrates a known firearm 24 with a known live round of the prior art. The live round 42 sits in the firing chamber 38 with the cartridge portion 44 seated on the shoulder 48 of the firing chamber 38. The slug portion 46 resides with the bore 30 of the barrel 32. The cartridge portion 44 includes a rim 50 which serves as a base for receipt of the firing pin 28 for firing of the firearm 24.

In accordance with the prior art, a live round 42 is loaded, either manually or automatically into the firing chamber 38. An extraction finger 22 engages with the circumferential recess 52 formed by the rim 50 of the cartridge portion 44. When the firing pin 28 strikes the live round 42 the slug 46 is ejected through the bore 30 of the barrel 32 to fire the firearm 24. Upon retraction of the slide 36 via an extraction rod (not shown), the extraction finger 22 pulls the spent cartridge 44 through the breach 34 to clear the firing chamber 38 in preparation for receipt of another live round 42 therein.

In contrast to the live round 42 of FIG. 7, the firearm safety device 10 of the present invention in FIG. 8 includes a base portion 12*a* and body portion 12*c* of the cartridge plug 12 that has a smooth outer surface 20. Since the cartridge plug 12 is devoid of a rim 50 and corresponding circumferential recess 52, the extraction finger 22 cannot grip the cartridge plug 12 and cannot, therefore, eject it. As a result, the cartridge plug 12 remains seated in the firing chamber 38 despite repeated full cycling of the firearm 24. Thus, dry firing can be carried out while the firearm safety device 10 remains installed within a firearm 24.

As stated above, the indicator member 14 is of a configuration that permits it to flex. Such flexing permits the indicator member 14 to accommodate the interior of the holster (not shown). As a result, a firearm 24 can be fully holstered even when the firearm safety device 10 is installed therein.

In view of the foregoing, a firearm safety device 10 is provided that can accurately indicate that a firearm 24 cannot be fired while also permitting the important training features of dry firing and holstering.

It will be appreciated by those skilled in the art that various changes and modifications can be made to the illustrated embodiments without departing from the spirit of the present invention. All such modifications and changes are intended to be covered by the appended claims.

What is claimed is:

1. A safety device for a firearm comprising:

a cartridge plug insertable into a firing chamber, having an inner wall, of a barrel of a firearm; the cartridge plug having a first end, a second end and an outer surface; the second end of the cartridge plug being positioned proximal to a bore through the barrel and the first end being positioned proximal to a firing pin of a firearm; means for frictionally securing the cartridge plug within the firing chamber; the means for frictionally securing being positioned on the outer surface of the cartridge plug and in frictional engagement with the inner wall of the firing chamber preventing removal of the cartridge from the firing chamber; and a flexible elongated indicator member, having a first end and a second end;

the first end of the elongated indicator member being connected to the second end of the cartridge plug; the second end of the elongated indicator member extending completely through the bore of the barrel and being visible outside the barrel of the firearm; the flexible elongated indicator member being capable of flexing to permit complete holstering of a firearm having the cartridge plug and flexible elongated indicator member installed therein.

2. The safety device of claim 1, wherein the means for frictionally securing Is at least one protrusion emanating outwardly from the outer surface of the cartridge plug.

3. The safety device of claim 1, wherein the first end of the cartridge plug is cylindrical in shape with a smooth outer surface; the smooth outer surface being in communication with an extraction finger of a firearm.

4. The safety device of claim 1, wherein the cartridge plug includes a plurality of longitudinal ribs.

5. The safety device of claim 1, wherein the elongated indicator member is of a flat strip-like configuration.

6. The safety device of claim 1, wherein the cartridge plug and elongated indicator member are integrally unitarily constructed from the same material.

7. The safety device of claim 1, wherein the cartridge plug and elongated indicator member are made of plastic.

8. The safety device of claim 1, wherein the cartridge plug is inwardly tapered from the first end to the second end of the cartridge plug.

9. A safety device for a firearm, comprising:

a cylindrical cartridge plug insertable into a firing chamber, having an inner wall, of a barrel of a firearm; the cartridge plug having a first end, a second end and a smooth outer surface; the second end of the cartridge plug being positioned proximal to a bore through the barrel and the first end being positioned proximal to a firing pin of a firearm;

the smooth outer surface being in communication with an extraction finger of a firearm;

a plurality of protrusions emanating outwardly from the outer surface of the cartridge plug; the protrusions with frictionally securing the outer surface of the cylindrical cartridge plug to the inner wall of the firing chamber; and a flexible elongated indicator member, having a first end and a second end;

the first end of the elongated indicator member being connected to the second end of the cartridge plug; the second end of the elongated indicator member extending completely through the bore of the barrel and being visible outside the barrel of the firearm; the flexible elongated indicator member being capable of flexing to permit complete holstering of a firearm having the cartridge plug and flexible elongated indicator member installed therein.

10. The safety device of claim 9, wherein the cartridge plug includes a plurality of longitudinal ribs.

11. The safety device of claim 9, wherein the elongated indicator member is of a flat strip-like configuration.

12. The safety device of claim 9, wherein the cartridge plug and elongated indicator member are integrally unitarily constructed from the same material.

13. The safety device of claim 9, wherein the cartridge plug and elongated indicator member are made of plastic.

* * * * *